US011944124B2

(12) United States Patent
Lee et al.

(10) Patent No.: US 11,944,124 B2
(45) Date of Patent: Apr. 2, 2024

(54) AEROSOL GENERATING DEVICE AND OPERATION METHOD THEREOF

(71) Applicant: KT&G CORPORATION, Daejeon (KR)

(72) Inventors: Won Kyeong Lee, Guri-si (KR); Min Kyu Kim, Daejeon (KR); Jong Sub Lee, Seongnam-si (KR); Byung Sung Cho, Gwangmyeong-si (KR)

(73) Assignee: KT&G CORPORATION, Daejeon (KR)

( * ) Notice: Subject to any disclaimer, the term of this patent is extended or adjusted under 35 U.S.C. 154(b) by 527 days.

(21) Appl. No.: 17/295,109

(22) PCT Filed: Dec. 11, 2020

(86) PCT No.: PCT/KR2020/018174
§ 371 (c)(1),
(2) Date: May 19, 2021

(87) PCT Pub. No.: WO2021/157842
PCT Pub. Date: Aug. 12, 2021

(65) Prior Publication Data

US 2022/0361583 A1 Nov. 17, 2022

(30) Foreign Application Priority Data

Feb. 5, 2020 (KR) ..... 10-2020-0013737

(51) Int. Cl.
*A24F 40/51* (2020.01)
*A24F 40/10* (2020.01)
*A24F 40/40* (2020.01)

(52) U.S. Cl.
CPC ..... *A24F 40/51* (2020.01); *A24F 40/10* (2020.01); *A24F 40/40* (2020.01)

(58) Field of Classification Search
CPC ..... A24F 40/51; A24F 40/10; A24F 40/40
(Continued)

(56) References Cited

U.S. PATENT DOCUMENTS 1,033,330 A * 7/1912 Lindgren ..... A01B 21/08 172/600
7,481,226 B2 * 1/2009 Cholet ..... A24F 13/12 131/330

(Continued)

FOREIGN PATENT DOCUMENTS

CN 108697171 A 10/2018
CN 109619696 A 4/2019

(Continued)

OTHER PUBLICATIONS

Extended European Search Report dated Dec. 6, 2021 in European Application No. 20888729.9.

(Continued)

*Primary Examiner* — Gary F Paumen
(74) *Attorney, Agent, or Firm* — Sughrue Mion, PLLC

(57) ABSTRACT

An aerosol generating device may include a heater configured to heat an aerosol generating material, a battery configured to supply power to the heater, and a controller. In addition, the aerosol generating device may further include a user input detection sensor configured to receive a user's input and a pressure detection sensor configured to sense pressure. The controller may, in response to the user's input being sensed by using the user input detection sensor, obtain an initial pressure sensing value by using the pressure detection sensor. In addition, the controller may determine a reference pressure value based on the initial pressure sensing value and determine whether a puff of the aerosol generating device has occurred based on the reference pressure value.

15 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 9,532,600 | B2 * | 1/2017 | Thorens | A24F 40/50 |
| 9,877,510 | B2 * | 1/2018 | Henry, Jr. | A24F 40/51 |
| 10,483,781 | B2 * | 11/2019 | Holzherr | H02J 7/00041 |
| 10,568,359 | B2 * | 2/2020 | Henry, Jr. | A24F 40/51 |
| 10,667,559 | B2 * | 6/2020 | Bessant | A61M 11/042 |
| 10,856,571 | B2 * | 12/2020 | Bessant | A24F 40/48 |
| 2006/0130860 | A1 | 6/2006 | Cholet | |
| 2013/0340750 | A1 | 12/2013 | Thorens et al. | |
| 2015/0282527 | A1 * | 10/2015 | Henry, Jr. | G01F 1/28 131/328 |
| 2017/0033568 | A1 | 2/2017 | Holzherr | |
| 2017/0119058 | A1 | 5/2017 | Cameron | |
| 2017/0259170 | A1 | 9/2017 | Bowen et al. | |
| 2018/0132536 | A1 * | 5/2018 | Henry, Jr. | A24F 40/50 |
| 2018/0146710 | A1 | 5/2018 | Bessant et al. | |
| 2018/0263296 | A1 | 9/2018 | Sebastian et al. | |
| 2018/0360117 | A1 * | 12/2018 | Yan | A24F 40/51 |
| 2019/0045837 | A1 | 2/2019 | Spencer | |
| 2019/0159519 | A1 * | 5/2019 | Bowen | H05B 1/0297 |
| 2019/0252888 | A1 * | 8/2019 | Holzherr | H02J 7/00 |
| 2019/0364969 | A1 | 12/2019 | Fu et al. | |
| 2020/0006950 | A1 * | 1/2020 | Holzherr | H02J 7/00 |
| 2020/0093185 | A1 * | 3/2020 | Lim | A24F 40/51 |
| 2020/0288777 | A1 * | 9/2020 | Bessant | A24F 40/50 |
| 2021/0084986 | A1 * | 3/2021 | Hepworth | A24F 40/60 |
| 2021/0106051 | A1 | 4/2021 | Han et al. | |
| 2021/0127748 | A1 | 5/2021 | Lim et al. | |

FOREIGN PATENT DOCUMENTS

| | | | |
|---|---|---|---|
| CN | 110475488 | A | 11/2019 |
| CN | 110545682 | A | 12/2019 |
| EP | 3372098 | A2 | 9/2018 |
| EP | 3488715 | A2 | 5/2019 |
| JP | 2022-120202 | A | 8/2022 |
| KR | 10-2019-0060708 | A | 6/2019 |
| WO | 2015/153443 | A1 | 10/2015 |
| WO | 2015/046420 | A1 | 3/2017 |
| WO | 2018/184861 | A1 | 10/2018 |
| WO | 2018/185460 | A1 | 10/2018 |
| WO | 2018/216961 | A1 | 11/2018 |

OTHER PUBLICATIONS

Chinese Office Action dated Apr. 21, 2023 in Chinese Application No. 202080012157.X.
Japanese Office Action dated Sep. 20, 2022, in Japanese Application No. 2021-547152.
Communication dated May 17, 2021 from the Korean Intellectual Property Office in KR application No. 10-2020-0013737.
International Search Report of PCT/KR2020/018174 dated Mar. 17, 2021 [PCT/ISA/210].
Written Opinion of PCT/KR2020/018174 dated Mar. 17, 2021 [PCT/ISA/237].

* cited by examiner

[Fig. 1]
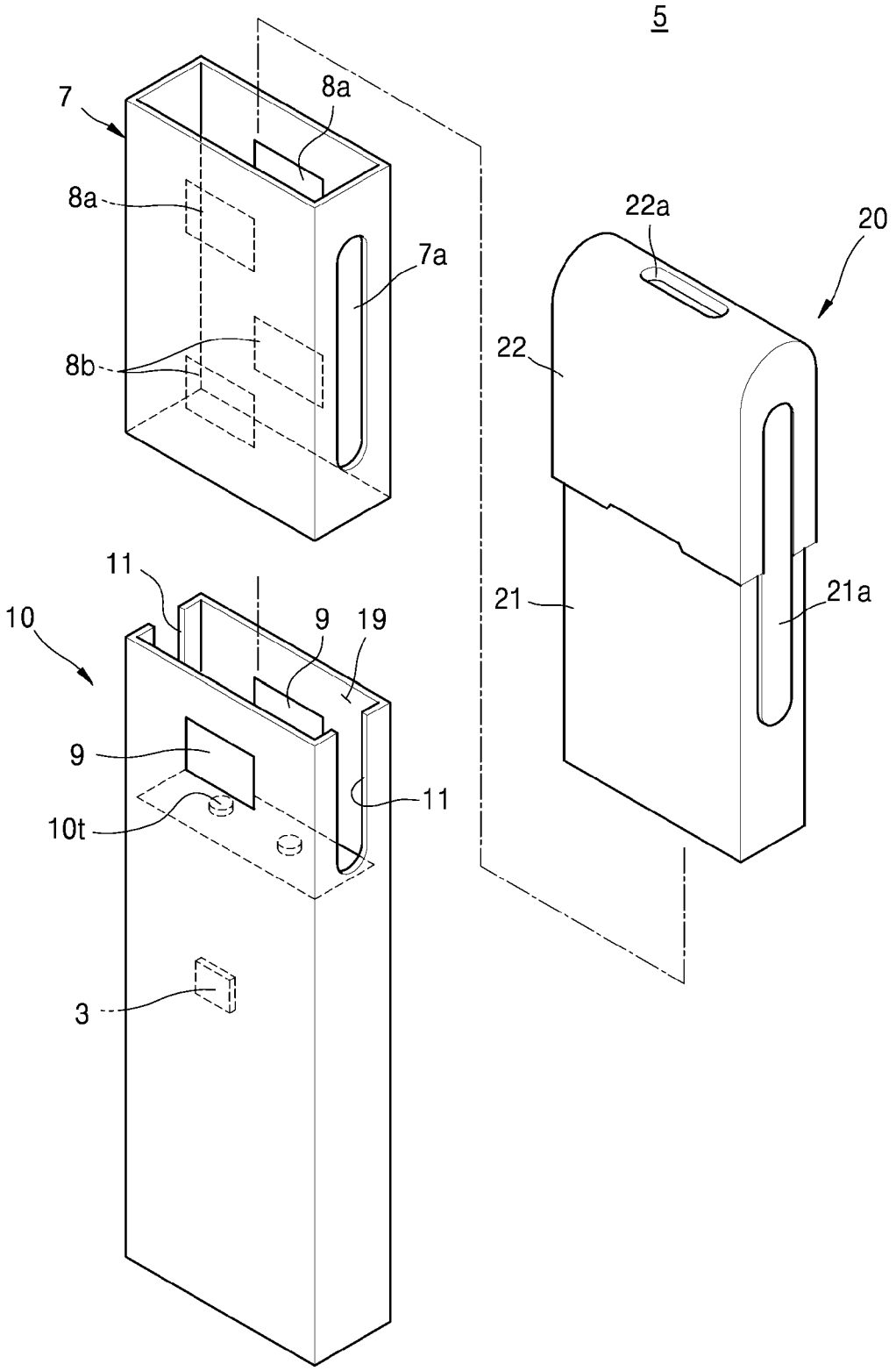

[Fig. 2]
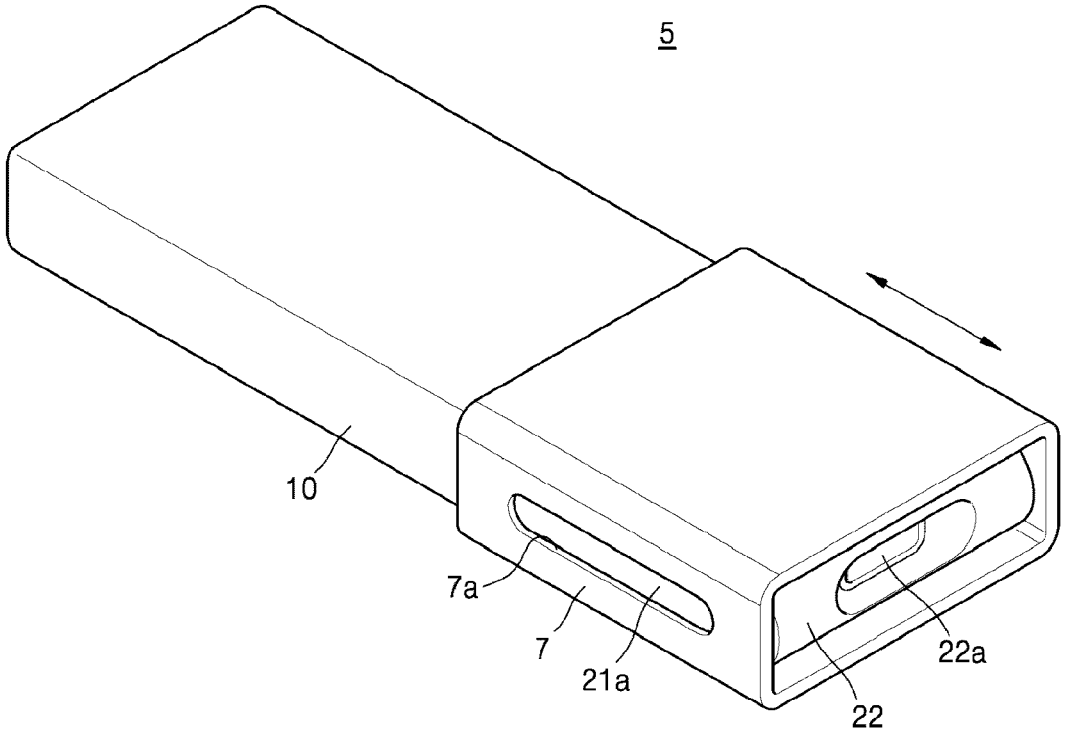
[Fig. 3]
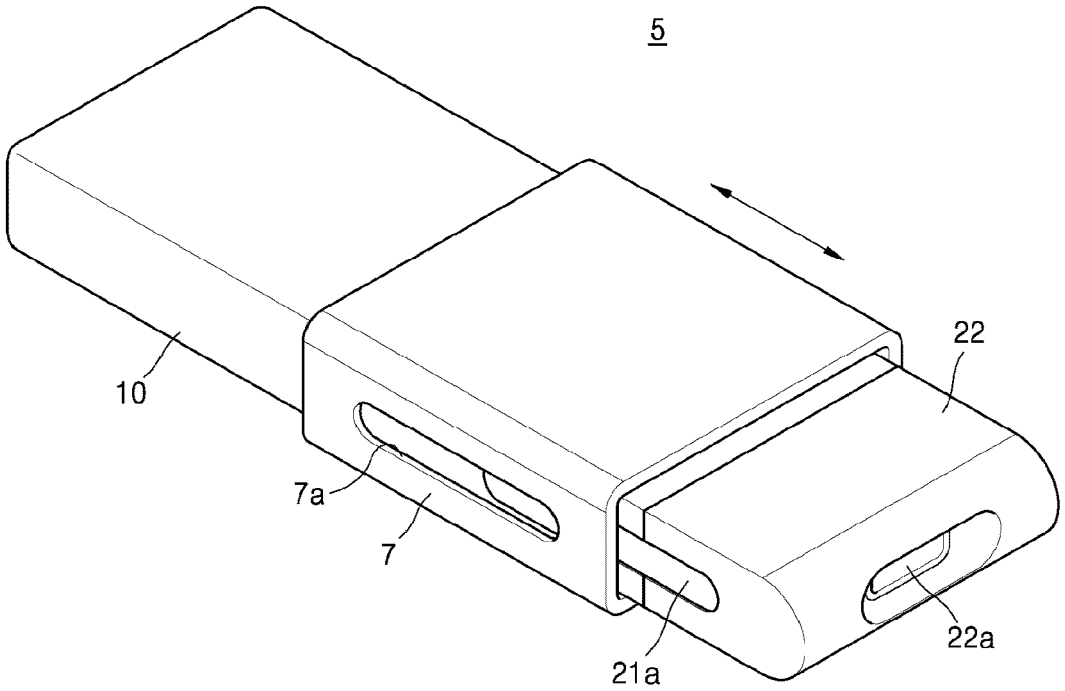

[Fig. 4]
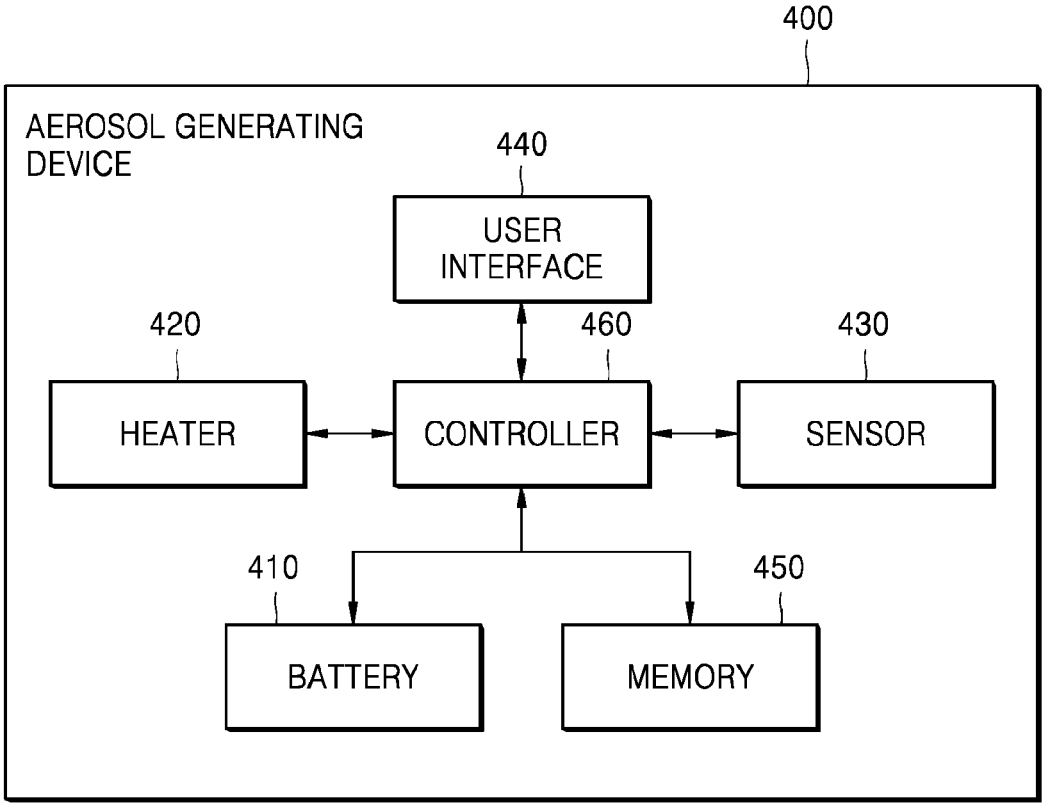
[Fig. 5]
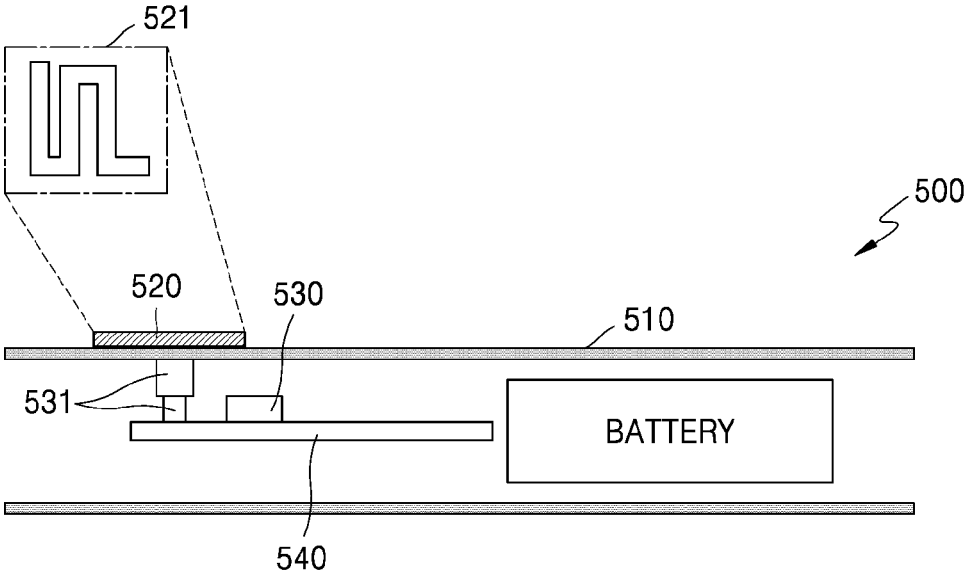

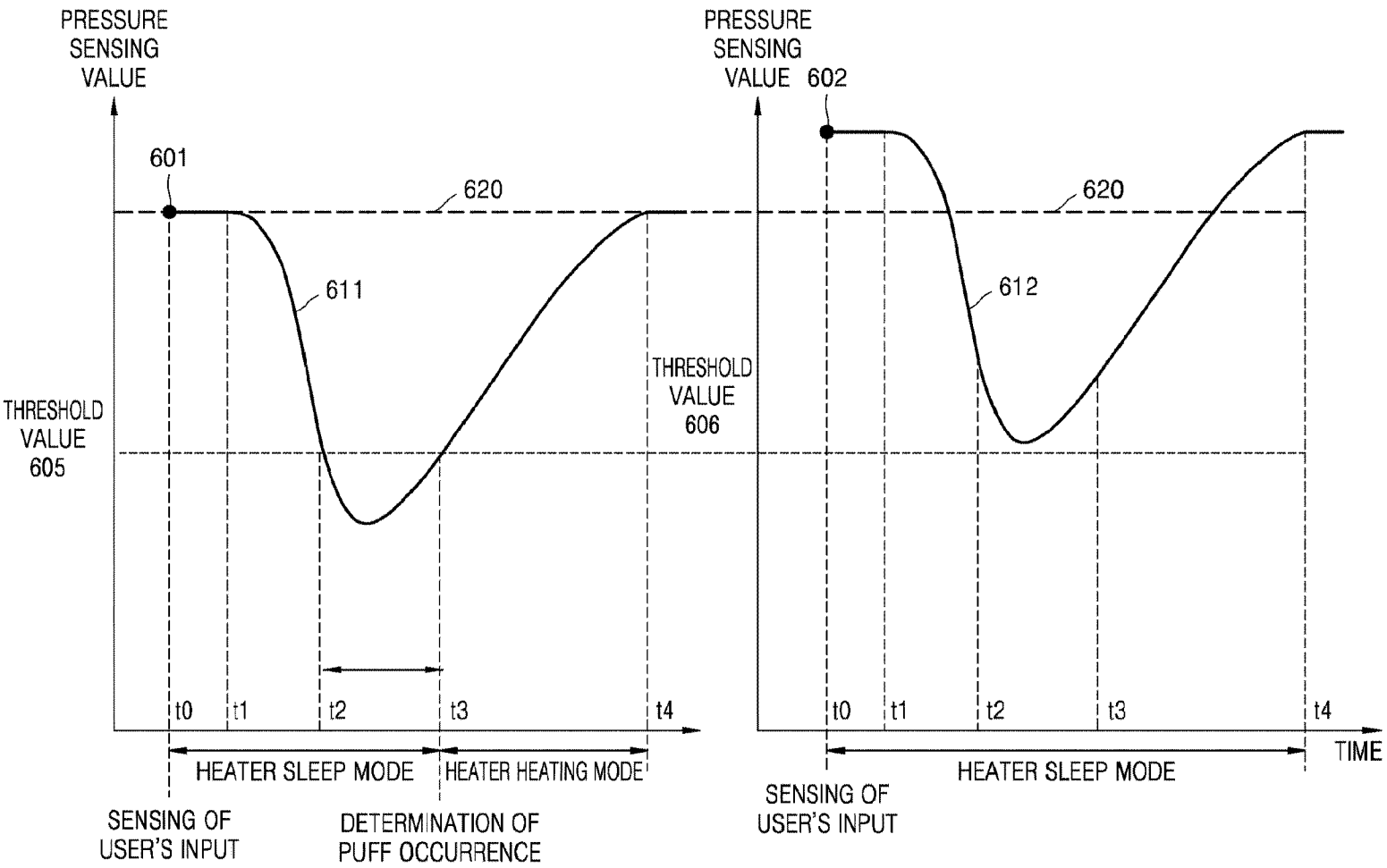
[Fig. 6]

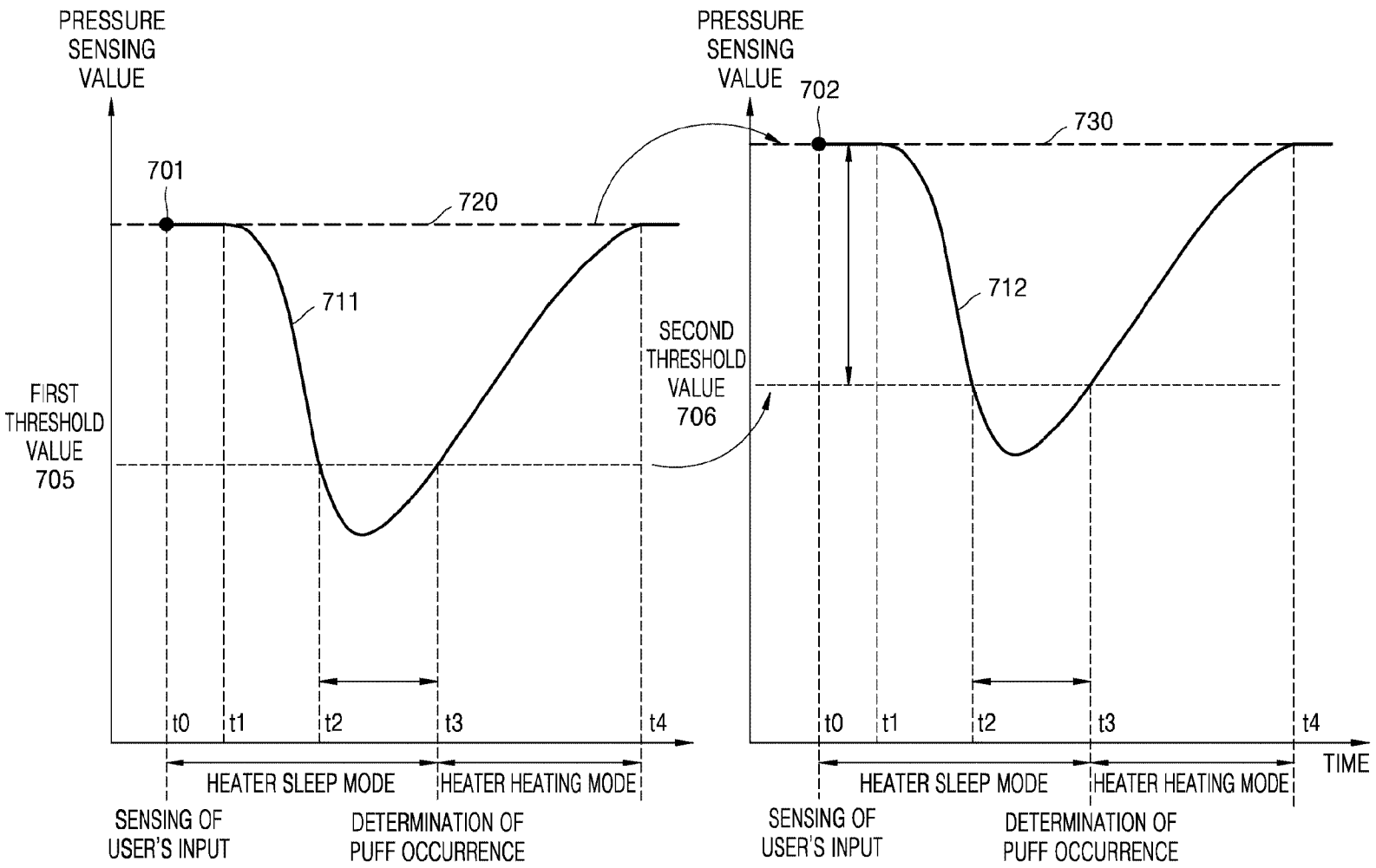
[Fig. 7]

[Fig. 8A]
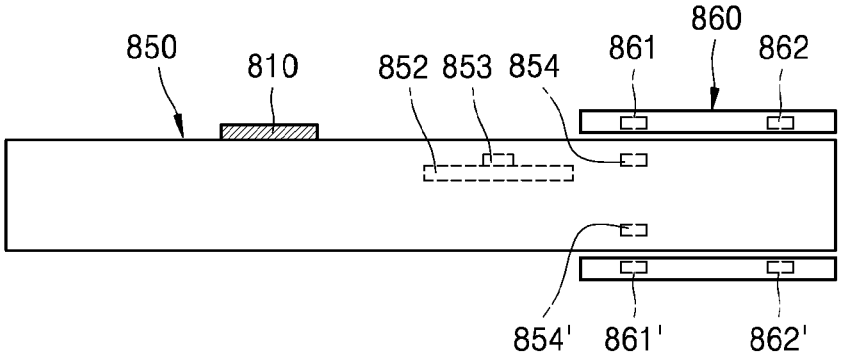
[Fig. 8B]
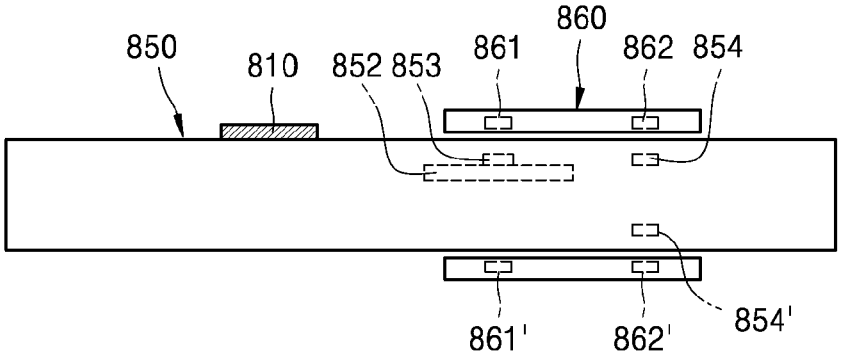
[Fig. 9]
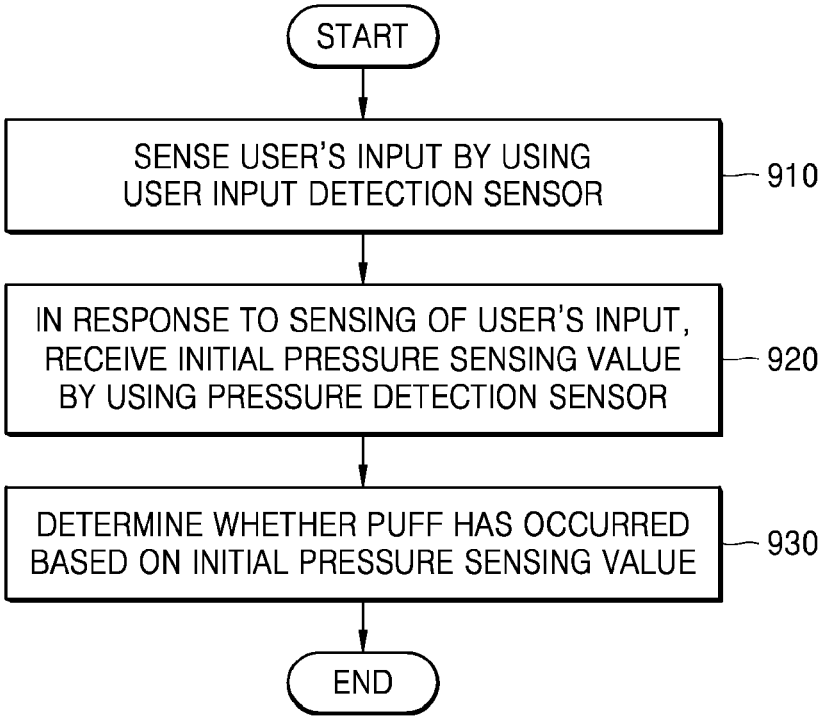

AEROSOL GENERATING DEVICE AND OPERATION METHOD THEREOF

CROSS REFERENCE TO RELATED APPLICATIONS

This application is a National Stage of International Application No. PCT/KR2020/018174, filed Dec. 11, 2020, claiming priority to Korean Patent Application No. 10-2020-0013737, filed Feb. 5, 2020.

TECHNICAL FIELD

Embodiments of the present disclosure relate to an aerosol generating device and an operation method thereof.

BACKGROUND ART

Recently, the demand for alternative methods of overcoming the shortcomings of general cigarettes has increased. For example, there is an increasing demand for a method of generating aerosols by heating an aerosol generating material, rather than by burning cigarettes.

A puff detection sensor of an aerosol generating device senses a pressure change, and a controller controls a heater based on the pressure change. An atmospheric pressure around an aerosol generating device may vary depending on an environment in which a user uses the aerosol generating device. Because a sensing value detected by a pressure detection sensor of an aerosol generating device may be affected by an atmospheric pressure around the aerosol generating device, a controller may misjudge whether a puff has occurred when the atmospheric pressure around the aerosol generating device changes.

DISCLOSURE OF INVENTION

Technical Problem

The technical problems are not limited to the above description of background art, and other technical problems may be understood and solved by the embodiments to be described hereinafter.

Solution to Problem

One or more embodiments of the present disclosure provide an aerosol generating device and an operation method thereof. In addition, one or more embodiments provide a device and method capable of accurately determining whether a puff has occurred by considering an atmospheric pressure around an aerosol generating device. In addition, one or more embodiments provide a computer-readable recording medium having recorded thereon a program for executing the method on a computer.

According to a first aspect of the present disclosure, an aerosol generating device may be provided, the device including: a heater configured to heat an aerosol generating material; a battery configured to supply power to the heater; a user input detection sensor configured to receive a user's input; a pressure detection sensor configured to sense pressure; and a controller, wherein the controller is configured to: in response to the user's input sensed by using the user input detection sensor, receive an initial pressure sensing value of the pressure detection sensor, and determine whether a puff has occurred based on the initial pressure sensing value.

Advantageous Effects of Invention

A time at which a user actually wants to use an aerosol generating device may be checked by using a user input detection sensor of the aerosol generating device. In embodiments of the present disclosure, it is possible to accurately determine whether a puff has occurred without being affected by an atmospheric pressure around an aerosol generating device by determining whether a puff has occurred by considering the atmospheric pressure around the aerosol generating device at the time at which the user actually wants to use the aerosol generating device.

In embodiments of the present disclosure, a rapid change in pressure outside an aerosol generating device being misjudged as the occurrence of a puff may be prevented by using a user input detection sensor and a position change detection sensor to determine whether to change a mode of the aerosol generating device.

BRIEF DESCRIPTION OF DRAWINGS

FIG. 1 is an exploded perspective view schematically illustrating a coupling relationship between a replaceable cartridge containing an aerosol generating material and an aerosol generating device including the same, according to an embodiment;

FIG. 2 is a perspective view of an example operating state of the aerosol generating device according to the embodiment illustrated in FIG. 1;

FIG. 3 is a perspective view of another example operating state of the aerosol generating device according to the embodiment illustrated in FIG. 1;

FIG. 4 is a block diagram illustrating hardware components of an aerosol generating device according to an embodiment;

FIG. 5 is a diagram for explaining an example of an operation of a user input detection sensor included in a main body of an aerosol generating device, according to an embodiment;

FIG. 6 is a diagram for explaining an example of determining whether a puff has occurred without considering an atmospheric pressure around an aerosol generating device, according to an embodiment;

FIG. 7 is a diagram for explaining an example of determining whether a puff has occurred by considering an atmospheric pressure around an aerosol generating device, according to an embodiment;

FIG. 8A is a first diagram for explaining operations of a user input detection sensor and a position change detection sensor, according to an embodiment;

FIG. 8B is a second diagram for explaining operations of a user input detection sensor and a position change detection sensor, according to an embodiment; and FIG. 9 is a flowchart illustrating a method of controlling an aerosol generating device according to an embodiment.

BEST MODE FOR CARRYING OUT THE INVENTION

According to one or more embodiments, an aerosol generating device is provided. The aerosol generating device may include: a heater configured to heat an aerosol generating material; a battery configured to supply power to the heater; a user input detection sensor configured to receive an input of a user; a pressure detection sensor configured to sense pressure; and a controller, wherein the controller is configured to: in response to the input of the user being sensed by using the user input detection sensor, obtain an initial pressure sensing value by using the pressure detection sensor; and determine whether a puff of the aerosol generating device has occurred based on the initial pressure sensing value.

According to an embodiment, the controller is further configured to determine a reference pressure value based on the initial pressure sensing value, determine a threshold value based on the reference pressure value, and determine whether the puff has occurred based on a sensing value of the pressure detection sensor and the threshold value.

According to an embodiment, the pressure detection sensor is further configured to sense a pressure change outside and inside the aerosol generating device.

According to an embodiment, the aerosol generating device further includes: a main body including the heater, the user input detection sensor, the pressure detection sensor, and the controller; and a slider movable along the main body, wherein the user input detection sensor is further configured to sense movement of the slider.

According to an embodiment, the controller is further configured to, in response to the movement of the slider being sensed by the user input detection sensor, switch a mode of the aerosol generating device from a sleep mode or an idle mode to a preheating mode or a heating mode.

According to an embodiment, the aerosol generating device further includes: a main body including the heater, the user input detection sensor, the pressure detection sensor, and the controller; and a slider movable along the main body, wherein the main body further includes a position change detection sensor configured to sense movement of the slider, and wherein the controller is further configured to, in response to the movement of the slider being sensed by the position change detection sensor, switch a mode of the aerosol generating device from a sleep mode or an idle mode to a pre-heating mode or a heating mode.

According to an embodiment, at least a portion of an outer surface of the aerosol generating device includes a metallic material, and the user input detection sensor is further configured to sense a change in capacitance according to the input of the user with respect to the metallic material.

According to an embodiment, the user input detection sensor includes a capacitive sensor.

According to an embodiment, the pressure detection sensor includes an absolute pressure sensor.

According to one or more embodiments, a method of controlling an aerosol generating device is provided, the method including: sensing an input of a user by using a user input detection sensor; in response to the sensing of the input of the user, obtaining, by a controller of the aerosol generating device, an initial pressure sensing value by using a pressure detection sensor; and determining, by the controller, whether a puff of the aerosol generating device has occurred based on the initial pressure sensing value.

According to an embodiment, the determining of whether the puff has occurred includes: determining a reference pressure value based on the initial pressure sensing value and determining a threshold value based on the reference pressure value; and determining whether the puff has occurred based on a sensing value of the pressure detection sensor and the threshold value.

According to an embodiment, at least a portion of an outer surface of the aerosol generating device includes a metallic material, and the sensing of the input of the user includes sensing a change in capacitance according to the input of the user with respect to the metallic material, by using the user input detection sensor.

According to an embodiment, the user input detection sensor includes a capacitive sensor.

According to an embodiment, the pressure detection sensor includes an absolute pressure sensor.

According to one or more embodiments, a non-transitory computer-readable medium storing computer code is provided. The computer code is configured to, when executed by at least one processor, cause the at least one processor to execute a method of the embodiments of the present disclosure.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

Hereinafter, example embodiments of the present disclosure will now be described more fully with reference to the accompanying drawings, such that one of ordinary skill in the art may easily work the present disclosure. Embodiments of the present disclosure may, however, be embodied in many different forms and should not be construed as being limited to the example embodiments set forth herein.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes a cartridge 20 containing the aerosol generating material and a main body 10 supporting the cartridge 20.

The cartridge 20 may be coupled to the main body 10 in a state in which the aerosol generating material is accommodated therein. A portion of the cartridge 20 is inserted into an accommodation space 19 of the main body 10 so that the cartridge 20 may be mounted on the main body 10.

The cartridge 20 may contain an aerosol generating material in any one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosols by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material by receiving the electrical signal from the main body 10 and heating the aerosol generating material, or by using an ultrasonic vibration method, or by using an induction heating method. As another example, when the cartridge 20 includes its own power source, the cartridge 20 may generate aerosols by being operated by an electric control signal or a wireless signal transmitted from the main body 10 to the cartridge 20.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element impregnated with (containing) an aerosol generating material, such as a sponge, cotton, fabric, or porous ceramic structure.

The atomizer may include, for example, a liquid delivery element (wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which performs both the functions of absorbing the aerosol generating material and maintaining the same in an optimal state for conversion to aerosol without using a separate liquid delivery element and the function of generating aerosol by heating the aerosol generating material.

At least a portion of the liquid storage 21 of the cartridge 20 may include a transparent material so that the aerosol generating material accommodated in the cartridge 20 may be visually identified from the outside. The liquid storage 21 includes a protruding window 21*a* protruding from the liquid storage 21, so that the protruding window 21*a* may be inserted into a groove 11 of the main body 10 when the liquid storage 21 is coupled to the main body 10. A mouthpiece 22 and the liquid storage 21 may be entirely formed of transparent plastic or glass, or only the protruding window 21*a* corresponding to a portion of the liquid storage 21 may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to an operation of the cartridge 20 to the cartridge 20.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 to move with respect to the main body 10. The slider 7 covers at least a portion of the mouthpiece 22 of the cartridge 20 coupled to the main body 10 or exposes at least a portion of the mouthpiece 22 to the outside by moving with respect to the main body 10. The slider 7 includes an elongated hole 7*a* exposing at least a portion of the protruding window 21*a* of the cartridge 20 to the outside.

The slider 7 has a container shape with a hollow space therein and both ends opened. The structure of the slider 7 is not limited to the container shape as shown in FIG. 1, and the slider 7 may have a bent plate structure having a clip-shaped cross-section, which is movable with respect to the main body 10 while being coupled to an edge of the main body 10, or a structure having a curved semi-cylindrical shape and a curved arc-shaped cross section.

The slider 7 includes a magnetic body for maintaining the position of the slider 7 with respect to the main body 10 and the cartridge 20. The magnetic body may include a permanent magnet or a material such as iron, nickel, cobalt, or an alloy thereof.

The magnetic body includes two first magnetic bodies 8*a* facing each other with an inner space of the slider 7 therebetween, and two second magnetic bodies 8*b* facing each other with the inner space of the slider 7 therebetween. The first magnetic bodies 8*a* and the second magnetic bodies 8*b* are arranged to be spaced apart from each other along a longitudinal direction of the main body 10, which is a moving direction of the slider 7, that is, the direction in which the main body 10 extends.

The main body 10 includes at least one fixed magnetic body 9 arranged on a path along which the first magnetic bodies 8*a* and the second magnetic bodies 8*b* of the slider 7 move while the slider 7 moves with respect to the main body 10. For example, two fixed magnetic bodies 9 of the main body 10 may be mounted to face each other with the accommodation space 19 therebetween.

Depending on the position of the slider 7, the slider 7 may be stably maintained in a position where an end of the mouthpiece 22 is covered or exposed by a magnetic force acting between at least one of the fixed magnetic bodies 9 and at least one of the first magnetic bodies 8*a* or between at least one of the fixed magnetic bodies 9 and at least one of the second magnetic bodies 8*b*.

The main body 10 includes a position change detection sensor 3 arranged on the path along which one of the first magnetic bodies 8*a* and one of the second magnetic bodies 8*b* of the slider 7 move while the slider 7 moves with respect to the main body 10. The position change detection sensor 3 may include, for example, a Hall IC using the Hall effect that detects a change in a magnetic field and generates a signal.

In the aerosol generating device 5 according to the above-described embodiments, the main body 10, the cartridge 20, and the slider 7 have approximately rectangular cross-sectional shapes in a direction transverse to the longitudinal direction, but in the embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly when extending in the longitudinal direction, and may extend a long way while being curved in a streamlined shape or bent at a preset angle in a specific area to be easily held by the user.

FIG. 2 is a perspective view of an example operating state of the aerosol generating device according to the embodiment illustrated in FIG. 1.

In FIG. 2, the operating state is shown in which the slider 7 is moved to a position where the end of the mouthpiece 22 of the cartridge 20 coupled to the main body 10 is covered. In a state where the slider 7 is moved to the position where the end of the mouthpiece 22 is covered, the mouthpiece 22 may be safely protected from external impurities and kept clean.

The user may check the remaining amount of aerosol generating material contained in the cartridge 20 by visually checking the protruding window 21*a* of the cartridge 20 through the elongated hole 7*a* of the slider 7. The user may move the slider 7 in the longitudinal direction of the main body 10 to use the aerosol generating device 5.

FIG. 3 is a perspective view of another example operating state of the aerosol generating device according to the embodiment illustrated in FIG. 1.

In FIG. 3, the operating state is shown in which the slider 7 is moved to a position where the end of the mouthpiece 22 of the cartridge 20 coupled to the main body 10 is exposed to the outside. In a state where the slider 7 is moved to the position where the end of the mouthpiece 22 is exposed to the outside, the user may insert the mouthpiece 22 into his or her mouth and inhale aerosol discharged through the discharge hole 22*a* of the mouthpiece 22.

Even when the slider 7 is moved to the position where the end of the mouthpiece 22 is exposed to the outside, the protruding window 21*a* of the cartridge 20 is exposed to the outside through the elongated hole 7*a* of the slider 7, and thus, the user may visually check the remaining amount of aerosol generating material contained in the cartridge 20.

FIG. 4 is a block diagram illustrating hardware components of an aerosol generating device according to an embodiment. The aerosol generating device 400 illustrated in FIG. 4 may correspond to the aerosol generating device 100 described above with reference to FIG. 1.

Referring to FIG. 4, an aerosol generating device 400 may include a battery 410, a heater 420, a sensor 430, a user interface 440, a memory 450, and a controller 460. However, the internal structure of the aerosol generating device 400 is not limited to those illustrated in FIG. 4. According to the design of the aerosol generating device 400, it will be understood by one of ordinary skill in the art that some of the hardware components shown in FIG. 4 may be omitted or new components may be added.

In an embodiment, the aerosol generating device 400 may consist of only a main body, in which case hardware components included in the aerosol generating device 400 are located in the main body. In another embodiment, the aerosol generating device 400 may consist of a main body and a cartridge, in which case hardware components included in the aerosol generating device 400 are located separately in the main body and the cartridge. Alternatively, at least some of hardware components included in the aerosol generating device 400 may be located in the main body and the cartridge, respectively.

Hereinafter, an operation of each of the components will be described without being limited to a particular location in the aerosol generating device 400.

The battery 410 supplies electric power used for the aerosol generating device 400 to operate. In other words, the battery 410 may supply power such that the heater 420 may be heated. In addition, the battery 410 may supply power required for operation of other hardware components included in the aerosol generating device 400, that is, the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat a cigarette inserted into the aerosol generating device 400, or heat the cartridge mounted on the aerosol generating device 400.

The heater 420 may be located in the main body of the aerosol generating device 400. Alternatively, when the aerosol generating device 400 consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an embodiment, the heater 420 may be a component included in the cartridge. The cartridge may include the heater 420, a liquid delivery element, and a liquid storage. The aerosol generating material accommodated in the liquid storage may be moved to the liquid delivery element, and the heater 420 may heat the aerosol generating material absorbed by the liquid delivery element, thereby generating aerosol. For example, the heater 420 may include a material such as nickel chromium and may be wound around or arranged adjacent to the liquid delivery element.

In another embodiment, the heater 420 may heat the cigarette inserted into an accommodation space of the aerosol generating device 400. As the cigarette is accommodated in the accommodation space of the aerosol generating device 400, the heater 420 may be located inside and/or outside the cigarette. Accordingly, the heater 420 may generate aerosol by heating the aerosol generating material in the cigarette.

The heater 420 may include an induction heater. The heater 420 may include an electrically conductive coil for heating a cigarette or the cartridge in an induction heating method, and the cigarette or the cartridge may include a susceptor which may be heated by the induction heater.

The aerosol generating device 400 may include at least one sensor 430. A result sensed by the at least one sensor 430 is transmitted to the controller 460, and the controller 460 may, according to the sensed result, control the aerosol generating device 400 to perform various functions such as controlling the operation of the heater 420, restricting smoking, determining whether a cigarette (or a cartridge) is inserted, and displaying a notification.

For example, the at least one sensor 430 may include a puff detection sensor. The puff detection sensor may sense a user's puff based on any one of a temperature change, a flow change, a voltage change, and a pressure change.

In addition, the at least one sensor 430 may include a temperature detection sensor. The temperature detection sensor may sense a temperature at which the heater 420 (or an aerosol generating material) is heated. The aerosol generating device 400 may include a separate temperature detection sensor for sensing a temperature of the heater 420, or the heater 420 itself may serve as a temperature detection sensor instead of including a separate temperature detection sensor. Alternatively, a separate temperature detection sensor may be further included in the aerosol generating device 400 while the heater 420 serves as a temperature detection sensor.

In addition, the at least one sensor 430 may include a position change detection sensor. The position change detection sensor may sense a change in a position of the slider coupled to the main body to move with respect to the main body.

The user interface 440 may provide the user with information about the state of the aerosol generating device 400. The user interface 440 may include various interfacing elements, such as a display or a lamp for outputting visual information, a motor for outputting haptic information, a speaker for outputting sound information, input/output (I/O) interfacing elements (for example, a button or a touch screen) for receiving information input from the user or outputting information to the user, terminals for performing data communication or receiving charging power, and communication interfacing modules for performing wireless communication (for example, Wi-Fi, Wi-Fi direct, Bluetooth, near-field communication (NFC), etc.) with external devices.

However, the aerosol generating device 400 may be implemented by selecting only some of the above-described various interfacing elements.

The memory 450 may be a hardware component configured to store various pieces of data processed in the aerosol generating device 400, and the memory 450 may store data processed or to be processed by the controller 460. The memory 450 may include various types of memories, such as random access memory (RAM) (e.g. dynamic random access memory (DRAM), static random access memory (SRAM), etc.), read-only memory (ROM), electrically erasable programmable read-only memory (EEPROM), etc.

The memory 450 may store an operation time of the aerosol generating device 400, the maximum number of puffs, the current number of puffs, at least one temperature profile, at least one power profile, data on a user's smoking pattern, etc.

The controller 460 is a hardware component configured to control general operations of the aerosol generating device 400. The controller 460 includes at least one processor. A processor may be implemented as an array of a plurality of logic gates or may be implemented as a combination of a general-purpose microprocessor and a memory in which a program executable in the microprocessor is stored. It will be understood by one of ordinary skill in the art that the processor may be implemented in other forms of hardware.

The controller 460 analyzes a result of the sensing by at least one sensor 430, and controls processes that are to be performed subsequently.

The controller 460 may control power supplied to the heater 420 so that the operation of the heater 420 is started or terminated, based on the result of the sensing by the at least one sensor 430. In addition, based on the result of the sensing by the at least one sensor 430, the controller 460 may control the amount of power supplied to the heater 420 and the time at which the power is supplied, so that the heater 420 is heated to a predetermined temperature or maintained at an appropriate temperature.

In an embodiment, the aerosol generating device 400 may have a plurality of modes. For example, modes of the aerosol generating device 400 may include a pre-heating mode, an operation mode, an idle mode, and a sleep mode. However, the modes of the aerosol generating device 400 are not limited thereto.

When the aerosol generating device 400 is not used, the aerosol generating device 400 may maintain the sleep mode, and the controller 460 may control an output power of the battery 410 such that the power is not supplied to the heater 420 in the sleep mode. For example, before the use of the aerosol generating device 400 or after the termination of the use of the aerosol generating device 400, the aerosol generating device 400 may operate in the sleep mode.

The controller 460 may, after receiving a user's input with respect to the aerosol generating device 400, set the mode of the aerosol generating device 400 to the pre-heating mode (or switching from the sleep mode to the pre-heating mode) to start the operation of the heater 420.

In addition, the controller 460 may switch the mode of the aerosol generating device 400 from the pre-heating mode to the heating mode after sensing a user's puff by using the puff detection sensor.

In addition, when the time at which the aerosol generating device 400 operates in the heating mode exceeds a preset time, the controller 460 may switch the mode of the aerosol generating device 400 from the heating mode to the idle mode.

Also, the controller 460 may stop supplying power to the heater 420 when the number of puffs reaches the maximum number of puffs after counting the number of puffs by using the puff detection sensor.

A temperature profile corresponding to each of the pre-heating mode, the heating mode, and the idle mode may be set. The controller 460 may control the power supplied to the heater 420 based on a power profile for each mode such that the aerosol generating material is heated according to the temperature profile for each mode.

The controller 460 may control the user interface 440 based on the result of the sensing by the at least one sensor 430. For example, when the number of puffs reaches a preset number after counting the number of puffs by using the puff detection sensor, the controller 460 may notify the user by using at least one of a lamp, a motor, or a speaker that the aerosol generating device 400 will soon be terminated.

Although not illustrated in FIG. 4, an aerosol generating system may be configured by the aerosol generating device 400 and a separate cradle. For example, the cradle may be used to charge the battery 410 of the aerosol generating device 400. For example, the aerosol generating device 400 may be supplied with power from a battery of the cradle to charge the battery 410 of the aerosol generating device 400 while being accommodated in an accommodation space of the cradle.

FIG. 5 is a diagram explaining an example of an operation of a user input detection sensor included in a main body of an aerosol generating device, according to an embodiment. The aerosol generating device may correspond to the aerosol generating device 100 and/or the aerosol generating device 400 described with reference to FIGS. 1 and 4.

Referring to FIG. 5, a main body 500 of the aerosol generating device may include a user input detection sensor 530. The user input detection sensor 530 may be located on a printed circuit board (PCB) 540.

The user input detection sensor 530 may receive a user's input with respect to the main body 500. The user input detection sensor 530 may be a capacitive sensor.

In an embodiment, a portion of an outer surface 510 of the main body 500 may be formed as a metallic material portion 520. In this case, the remaining portions of the outer surface 510 of the main body 500, the remaining portion excluding the metallic material portion 520, may be formed of a non-metallic material. The user input detection sensor 530 and the metallic material portion 520 may be electrically connected through a clip 531, but the method in which the user input detection sensor 530 and the metallic material portion 520 are connected is not limited thereto.

The user input detection sensor 530 may sense a user's input with respect to the metallic material portion 520. For example, when the user touches the metallic material portion 520, a change in capacitance occurs, and the user input detection sensor 530 may sense the user's input by sensing the change in capacitance. A controller (e.g. controller 460 illustrated in FIG. 4) may determine whether the user's input has occurred by comparing values before and after the change in capacitance received from the user input detection sensor 530. When a value obtained by comparing the values before and after the change in capacitance exceeds a preset threshold value, the controller may determine that the user's input has occurred.

When the user touches the non-metallic portion other than the metallic material portion 520 of the outer surface 510 of the main body 500, a change in capacitance may not occur. The controller may, by comparing the values before and after the change in capacitance received from the user input detection sensor 530, determine the user's input has not occurred when the value obtained by comparing the values before and after the change in capacitance is less than or equal to the preset threshold value.

A user's input method to the metallic material portion 520 may be changed according to a position where the metallic material portion 520 is formed on the outer surface 510 of the main body 500. For example, when the metallic material portion 520 corresponds to the size of one finger joint, the user may touch the metallic material portion 520 with a finger. Alternatively, when the metallic material portion 520 surrounds the outer surface 510 of the main body 500, the user may touch the metallic material portion 520 by grasping the main body 500.

The metallic material portion 520 may be formed as a dummy pattern 521. The shape of the dummy pattern 521 may be variously modified depending on the position where the metallic material portion 520 is formed. The dummy pattern 521 of the metallic material portion 520 may be determined by considering the position where the metallic material portion 520 is formed and the user's input method to the metallic material portion 520, such that the user input detection sensor 530 may effectively detect a change in capacitance.

In another embodiment, the entire outer surface 510 of the main body 500 may be formed as the metallic material portion 520. In this case, regardless of which portion of the outer surface 510 of the main body 500 is touched by the user, the user input detection sensor 530 may sense the user's input.

FIG. 6 is a diagram explaining an example of determining whether a puff has occurred without considering an atmospheric pressure around an aerosol generating device, according to an embodiment. The aerosol generating device may correspond to the aerosol generating device 100, the aerosol generating device 400, and/or the aerosol generating device described with reference to FIGS. 1, 4, and 5.

The aerosol generating device includes a heater (e.g. heater 420 illustrated in FIG. 4) heating an aerosol generating material, a battery (e.g. battery 410 illustrated in FIG. 4) supplying power to the heater, and a controller (e.g. controller 460 illustrated in FIG. 4) controlling an overall operation of the aerosol generating device.

In addition, the aerosol generating device may further include a user input detection sensor receiving a user's input and a pressure detection sensor sensing pressure (e.g. as a part of the at least one sensor 430 illustrated in FIG. 4). The pressure detection sensor may sense the pressure inside and outside the aerosol generating device. The pressure detection sensor may be an absolute pressure sensor. For example, the pressure detection sensor may be a microelectromechanical system (MEMS).

The pressure outside the aerosol generating device may correspond to an atmospheric pressure around the aerosol generating device. The pressure around the aerosol generating device may vary depending on temperature, altitude, or the like. For example, when a user uses the aerosol generating device at a high altitude, a pressure sensing value outside the aerosol generating device is relatively small, and when the user uses the aerosol generating device at a low altitude, the pressure sensing value outside the aerosol generating device is relatively large.

The pressure inside the aerosol generating device may vary depending on a user's puff strength. For example, when the user puffs strongly, a pressure sensing value inside the aerosol generating device is relatively small, and when the user puffs weakly, the pressure sensing value inside the aerosol generating device is relatively large.

The user input detection sensor may receive a user's input with respect to the aerosol generating device. For example, the user input detection sensor may be a capacitive sensor. The user input detection sensor may correspond to the user input detection sensor 530 described with reference to FIG. 5.

Referring to FIG. 6, both of a first graph 611 and a second graph 612 represent changes in sensing values measured by the pressure detection sensor according to the user's puffs. In FIG. 6, although a first initial pressure sensing value 601 of the first graph 611 and a second initial pressure sensing value 602 are different, reference pressure values 620 with respect to the first graph 611 and the second graph 612 are equally set.

Referring to the first graph 611, the user input detection sensor may receive a user's input at $t_0$, and the controller may determine that the user's input is sensed. In response to the user's input being sensed, an operation of the pressure detection sensor is started. The pressure detection sensor may not sense pressure before $t_0$, and may obtain the first initial pressure sensing value 601 at $t_0$. The first initial pressure sensing value 601 may be determined according to the atmospheric pressure around the aerosol generating device.

The reference pressure value 620 may be set as a sensing value of the pressure detection sensor at a particular temperature and a particular pressure. For example, a sensing value of the pressure detection sensor at 0° C. and 1 atmospheric pressure may be set as the reference pressure value 620. The preset reference pressure value 620 may be stored in a memory (e.g. memory 450 illustrated in FIG. 4) of the aerosol generating device.

The user's puff may occur at $t_1$ after a certain time has passed from $t_0$. The sensing value of the pressure detection sensor may be maintained as the first initial pressure sensing value 601 during $t_0$ to $t_1$, and a sensing value of the pressure detection sensor from $t_1$ may decrease below the first initial pressure sensing value 601.

In addition, as the puff progresses, the sensing value of the pressure detection sensor at $t_1$ to $t_2$ has a value between the first initial pressure sensing value 601 and a threshold value 605. The threshold value 605 may be determined based on the reference pressure value 620. For example, the threshold value 605 may be determined to be a value between 30% and 70% of the reference pressure value 620, but the criterion determining the threshold value 605 is not limited thereto.

When the sensing value of the pressure detection sensor is maintained below the threshold value 605 for a certain time, the controller may determine that a puff has occurred. The certain time may be between 0.1 seconds and 2.0 seconds, but is not limited thereto.

Referring to the first graph 611, as the sensing value of the pressure detection sensor is maintained below the threshold value 605 for a certain time ($t_2$ to $t_3$), the controller may determine that a puff has occurred at $t_3$. The controller may, after determining that the puff has occurred at $t_3$, switch the mode of the aerosol generating device from the sleep mode or the idle mode to the pre-heating mode or the heating mode.

For example, when it is determined that the puff has occurred while the aerosol generating device is in the sleep mode, the controller may switch the mode of the aerosol generating device from the sleep mode to the pre-heating mode.

Alternatively, when it is determined that the puff has occurred while the aerosol generating device is in the idle mode, the controller may switch the mode of the aerosol generating device from the idle mode to the heating mode.

The sleep mode is a mode in which the aerosol generating device does not operate, and power may not be supplied to the heater in the sleep mode. The heating mode refers to a mode in which aerosols are generated by heating an aerosol generating material by supplying power to the heater. The preheating mode refers to a mode in which the temperature of the heater is raised to a certain temperature before switching from the sleep mode to the heating mode such that sufficient atomization occurs immediately in the heating mode. The idle mode is a mode in which the puff is stopped while power is being supplied to the heater. In the idle mode, power supply to the heater may be stopped or an amount of power supplied may be reduced compared to the heating mode.

Referring to the second graph 612, the user input detection sensor may receive the user's input at $t_0$, and the controller may determine that the user's input is sensed. In response to the user's input being sensed, an operation of the pressure detection sensor is started. The pressure detection sensor may not sense pressure before $t_0$, and may obtain the second initial pressure sensing value 602 at $t_0$. The second initial pressure sensing value 602 may be determined according to the atmospheric pressure around the aerosol generating device.

Comparing the first graph 611 and the second graph 612, the first initial pressure sensing value 601 of the first graph 611 and the second initial pressure sensing value 602 of the second graph 612 are different. For example, the first graph 611 may be a case of which the aerosol generating device operates at 1 atmospheric pressure, and the second graph 612 may be a case of which the aerosol generating device operates at 1.5 atmospheric pressure.

In FIG. 6, the reference pressure values 620 with respect to the first graph 611 and the second graph 612 are equally set. In addition, because the threshold value 605 is determined based on the reference pressure value 620, the threshold value 605 with respect to the first graph 611 and the threshold value 606 with respect to the second graph 612 are also determined equally.

The first graph 611 and the second graph 612 are graphs showing changes in sensing values measured by the pressure detection sensor for the same puff pattern. Although the controller should have determined that a puff has occurred at $t_3$ of the second graph 612, as determined that the puff has occurred at $t_3$ of the first graph 611, the controller determines that no puff has occurred in the second graph 612 as the second initial pressure sensing value 602 of the second graph 612 is greater than the first initial pressure sensing value 601 of the first graph 611. In the second graph 612, as it is determined that no puff has occurred, the controller maintains the mode of the aerosol generating device in the sleep mode or the idle mode.

FIG. 7 is a diagram explaining an example of determining whether a puff has occurred by considering an atmospheric pressure around an aerosol generating device, according to an embodiment.

Hereinafter, descriptions overlapping with FIG. 6 will be omitted for convenience.

Referring to FIG. 7, both of a first graph 711 and a second graph 712 represent changes in sensing values measured by the pressure detection sensor according to the user's puffs. In FIG. 7, a first initial pressure sensing value 701 of the first graph 711 and a second initial pressure sensing value 702 of the second graph 712 are different.

Referring to the first graph 711, the user input detection sensor may receive the user's input at $t_0$, and the controller may determine that the user's input is sensed. In response to the user's input being sensed, an operation of the pressure detection sensor is started. The pressure detection sensor may not sense pressure before $t_0$, and may obtain the first initial pressure sensing value 701 at $t_0$. The first initial pressure sensing value 701 may be determined according to the atmospheric pressure around the aerosol generating device.

The controller may determine a first reference pressure value 720 based on the first initial pressure sensing value 701 of the pressure detection sensor. In FIG. 7, the first initial pressure sensing value 701 is determined as the first reference pressure value 720.

The user's puff may occur at $t_1$ after a certain time has passed from $t_0$. The sensing value of the pressure detection sensor may be maintained as the first initial pressure sensing value 701 during $t_0$ to $t_1$, and a sensing value of the pressure detection sensor from $t_1$ may decrease below the first initial pressure sensing value 701.

In addition, as the puff progresses, the sensing value of the pressure detection sensor at $t_1$ to $t_2$ has a value between the first initial pressure sensing value 701 and a first threshold value 705. The first threshold value 705 may be determined based on the first reference pressure value 720. For example, the first threshold value 705 may be determined to be a value between 30% and 70% of the first reference pressure value 720, but the criterion determining the first threshold value 705 is not limited thereto.

When the sensing value of the pressure detection sensor is maintained below the first threshold value 705 for a certain time, the controller may determine that a puff has occurred. Referring to the first graph 711, as the sensing value of the pressure detection sensor is maintained below the first threshold value 705 for a certain time ($t_2$ to $t_3$), the controller may determine that a puff has occurred at $t_3$. The controller may, after determining that the puff has occurred at $t_3$, switch the mode of the aerosol generating device from the sleep mode or the idle mode to the pre-heating mode or the heating mode.

Referring to the second graph 712, the user input detection sensor may receive the user's input at $t_0$, and the controller may determine that the user's input is sensed. In response to the user's input being sensed, an operation of the pressure detection sensor is started. The pressure detection sensor may not sense pressure before $t_0$, and may obtain the second initial pressure sensing value 702 at $t_0$. The second initial pressure sensing value 702 may be determined according to the atmospheric pressure around the aerosol generating device.

Comparing the first graph 711 and the second graph 712, the first initial pressure sensing value 701 of the first graph 711 and the second initial pressure sensing value 702 of the second graph 712 are different. For example, the first graph 711 may be a case of which the aerosol generating device operates at 1 atmospheric pressure, and the second graph 712 may be a case of which the aerosol generating device operates at 1.5 atmospheric pressure.

The controller may set a second reference pressure value 730 based on the second initial pressure sensing value 702 of the pressure detection sensor. In FIG. 7, the second initial pressure sensing value 702 is determined as the second reference pressure value 730.

The user's puff may occur at $t_1$ after a certain time has passed from $t_0$. The sensing value of the pressure detection sensor may be maintained as the second initial pressure sensing value 702 during $t_0$ to $t_1$, and a sensing value of the pressure detection sensor from $t_1$ may decrease below the second initial pressure sensing value 702.

In addition, as the puff progresses, the sensing value of the pressure detection sensor at $t_1$ to $t_2$ has a value between the second initial pressure sensing value 702 and a second threshold value 706. The second threshold value 706 may be determined based on the second reference pressure value 730. For example, the second threshold value 706 may be determined to be a value between 30% and 70% of the second reference pressure value 730, but the criterion determining the second threshold value 706 is not limited thereto.

When the sensing value of the pressure detection sensor is maintained below the second threshold value 706 for a certain time, the controller may determine that a puff has occurred. Referring to the second graph 712, as the sensing value of the pressure detection sensor is maintained below the second threshold value 706 for a certain time ($t_2$ to $t_3$), the controller may determine that a puff has occurred at $t_3$. The controller may, after determining that the puff has occurred at $t_3$, switch the mode of the aerosol generating device from the sleep mode or the idle mode to the pre-heating mode or the heating mode.

The controller may determine a reference pressure value based on an initial pressure sensing value. As compared with FIG. 6, because the first initial pressure sensing value 701 of the first graph 711 and the second initial pressure sensing value 702 of the second graph 712 are different in FIG. 7, the first reference pressure value 720 with respect to the first graph 711 and the second reference pressure value 730 with respect to the second graph 712 are also different.

In addition, the controller may determine a threshold value based on the reference pressure value. As compared with FIG. 6, in FIG. 7, the first threshold value 705 with respect to the first graph 711 and the second threshold value 706 with respect to the second graph 712 are also different.

The first graph 711 and the second graph 712 are graphs showing changes in sensing values measured by the pressure detection sensor for the same puff pattern. Even when the atmospheric pressure around the aerosol generating device at the time when the user's input is sensed is different, as in the first initial pressure sensing value 701 and the second initial pressure sensing value 702, the controller may determine that the puff has occurred at $t_3$ in both of the first graph 711 and the second graph 712.

In embodiments of the present disclosure, a time at which the user actually wants to use the aerosol generating device may be checked by using the user input detection sensor of the aerosol generating device. In addition, in embodiments of the present disclosure, it is possible to determine whether the puff has occurred by considering the atmospheric pressure around the aerosol generating device at the time at which the user actually wants to use the aerosol generating device. Accordingly, in embodiments of the present disclosure, it is possible to accurately determine whether a puff has occurred without being affected by the atmospheric pressure around the aerosol generating device.

FIGS. 8A and 8B are diagrams explaining operations a user input detection sensor and a position change detection sensor, according to an embodiment.

An aerosol generating device may include a main body 850 and a slider 860. The slider 860 may be movable along the main body 850. In addition, a position change detection sensor 853 may be included in the main body 850 of the aerosol generating device. According to embodiments, the aerosol generating device may correspond to the aerosol generating device 100, the aerosol generating device 400, and/or the aerosol generating device described with reference to FIGS. 1, 4, and 5.

The position change detection sensor 853 may sense the movement of the slider 860 which is movable along the main body 850. The position change detection sensor 853 may be a proximity sensor. For example, the position change detection sensor 853 may include a magnetic sensor, a capacitive sensor, or the like, but is not limited thereto. Hereinafter, it is assumed that the position change detection sensor 853 is a magnetic sensor.

FIG. 8A shows that the slider 860 is located in a first position of the main body 850, and FIG. 8B shows that the slider 860 is located in a second position of the main body 850.

When the slider 860 is located in the first position, a magnet 861 is arranged away from the position change detection sensor 853, and when the slider 860 is located in the second position, the magnet 861 is arranged adjacent to the position change detection sensor 853.

As the slider 860 moves between the first position and the second position, the position change detection sensor 853 may sense a change in a magnetic field due to the magnet 861 inside the slider 860. For example, the position change detection sensor 853 may sense a voltage generated by the magnetic field of the magnet 861. The position change detection sensor 853 may sense the movement of the slider 860 by sensing the change in the magnetic field.

When the slider 860 is located in the second position, second magnetic coupling members 862 and 862' may be arranged adjacent to first magnetic coupling members 854 and 854'. At this time, the second magnetic coupling members 862 and 862' and the first magnetic coupling members 854 and 854' may be magnetically coupled. To this end, at least one of the first magnetic coupling members and the second magnetic coupling members may have magnetic properties. For example, the first magnetic coupling members 854 and 854' may be magnets, and the second magnetic coupling members 862 and 862' may be iron plates. As the second magnetic coupling members 862 and 862' and the first magnetic coupling members 854 and 854' are magnetically coupled, the second magnetic coupling members 862 and 862' may be fixed to the second position.

When the slider 860 is located in the first position, magnets 861 and 861' may be arranged adjacent to the first magnetic coupling members 854 and 854'. At this time, the magnets 861 and 861' may be magnetically coupled to the first magnetic coupling members 854 and 854'. As the magnets 861 and 861' and the first magnetic coupling members 854 and 854' are magnetically coupled, the slider 860 may be fixed to the first position.

In an embodiment, a user input detection sensor 810 may receive a user's input. For example, the user input detection sensor 810 may be a capacitive sensor. The user input detection sensor 810 may receive the user's input, and the controller may determine that the user's input is sensed. In response to the user's input being sensed, an operation of a pressure detection sensor is started.

The controller may receive an initial pressure sensing value from the pressure detection sensor, determine a reference pressure value based on the initial pressure sensing value, and determine whether a puff has occurred based on the reference pressure value. The controller may, after determining that the puff has occurred, switch a mode of the aerosol generating device from a sleep mode or an idle mode to a pre-heating mode or a heating mode.

The position change detection sensor 853 may sense the movement of the slider 860. The controller may, in response to the position change detection sensor 853 sensing the movement (for example, the movement from the first position to the second position) of the slider 860, switch the mode of the aerosol generating device from the sleep mode or the idle mode to the pre-heating mode or the heating mode.

For example, even when the controller determines that the puff has occurred, when the position change detection sensor 853 does not sense the movement of the slider 860, the controller may not switch the mode of the aerosol generating device from the sleep mode or the idle mode to the pre-heating mode or the heating mode.

In embodiments of the present disclosure, a rapid change in the pressure outside the aerosol generating device being misjudged as the occurrence of a puff may be prevented by using the user input detection sensor 810 and the position change detection sensor 853 to determine whether to change the mode of the aerosol generating device.

In another embodiment, when the user input detection sensor 810 and the position change detection sensor 853 are capacitive sensors, the user input detection sensor 810 and the position change detection sensor 853 may be implemented as a single sensor. The single sensor may serve as both of the user input detection sensor 810 and the position change detection sensor 853 described above.

FIG. 9 is a flowchart illustrating a method of controlling an aerosol generating device according to an embodiment.

Referring to FIG. 9, in operation 910, a controller may sense a user's input by using a user input detection sensor.

In an embodiment, the controller may, when a sensing value equal to or greater than a present threshold value is received from the user input detection sensor, determine that the user's input has occurred.

The user input detection sensor may receive the user's input with respect to the aerosol generating device. The user input detection sensor may be a capacitive sensor.

At least a portion of the aerosol generating device may include a metallic material. The user input detection sensor may sense a change in capacitance according to a user's input with respect to the metallic material.

A metallic material portion of the aerosol generating device may be formed in a dummy pattern. The shape of the dummy pattern may be variously modified depending on the position of which the metallic material portion is formed. The dummy pattern of the metallic material portion may be determined by considering the position of which the metallic material portion is formed and a user input method with respect to the metallic material portion.

In operation 920, the controller may, in response to sensing the user's input, receive an initial pressure sensing value by using a pressure detection sensor.

The pressure detection sensor may sense the pressure inside and outside the aerosol generating device. The pressure detection sensor may be an absolute pressure sensor. For example, the pressure detection sensor may be a MEMS.

The pressure detection sensor may obtain the initial pressure sensing value based on the atmospheric pressure around the aerosol generating device.

In operation 930, the controller may determine whether a puff has occurred based on the initial pressure sensing value.

The controller may determine a reference pressure value based on the initial pressure sensing value. The reference pressure value may be determined as the initial pressure sensing value. Alternatively, the reference pressure value may be determined as a value obtained by correcting the initial pressure sensing value.

The controller may determine a threshold value based on the reference pressure value. For example, the threshold value may be determined as a value between 30% and 70% of the reference pressure value, but the criterion determining the threshold value is not limited thereto.

The controller may determine whether a puff has occurred based on the sensing value of the pressure detection sensor and the threshold value. For example, when the sensing value of the pressure detection sensor is maintained below the threshold value for a certain time, the controller may determine that a puff has occurred. The certain time may be between 0.1 seconds and 2.0 seconds, but is not limited thereto.

The controller may, after determining that the puff has occurred, switch a mode of the aerosol generating device from a sleep mode or an idle mode to a pre-heating mode or a heating mode.

One embodiment may also be implemented in the form of a recording medium including instructions executable by a computer, such as a program module executable by the computer. The computer-readable recording medium may be any available medium that can be accessed by a computer, including both volatile and nonvolatile media, and both removable and non-removable media. In addition, The computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made.

The invention claimed is:

1. An aerosol generating device comprising:

a heater configured to heat an aerosol generating material;

a battery configured to supply power to the heater;

a user input detection sensor configured to receive an input of a user;

a pressure detection sensor configured to sense pressure; and a controller, wherein the controller is configured to:

in response to the input of the user being sensed by using the user input detection sensor, obtain an initial pressure sensing value by using the pressure detection sensor; and determine whether a puff of the aerosol generating device has occurred based on the initial pressure sensing value.

2. The aerosol generating device of claim 1, wherein the controller is further configured to determine a reference pressure value based on the initial pressure sensing value, determine a threshold value based on the reference pressure value, and determine whether the puff has occurred based on a sensing value of the pressure detection sensor and the threshold value.

3. The aerosol generating device of claim 1, wherein the pressure detection sensor is further configured to sense a pressure change outside and inside the aerosol generating device.

4. The aerosol generating device of claim 1, further comprising:

a main body comprising the heater, the user input detection sensor, the pressure detection sensor, and the controller; and a slider movable along the main body, wherein the user input detection sensor is further configured to sense movement of the slider.

5. The aerosol generating device of claim 4, wherein the controller is further configured to, in response to the movement of the slider being sensed by the user input detection sensor, switch a mode of the aerosol generating device from a sleep mode or an idle mode to a pre-heating mode or a heating mode.

6. The aerosol generating device of claim 1, further comprising:

a main body comprising the heater, the user input detection sensor, the pressure detection sensor, and the controller; and a slider movable along the main body, wherein the main body further comprises a position change detection sensor configured to sense movement of the slider, and wherein the controller is further configured to, in response to the movement of the slider being sensed by the position change detection sensor, switch a mode of the aerosol generating device from a sleep mode or an idle mode to a pre-heating mode or a heating mode.

7. The aerosol generating device of claim 1, wherein at least a portion of an outer surface of the aerosol generating device comprises a metallic material, and the user input detection sensor is further configured to sense a change in capacitance according to the input of the user with respect to the metallic material.

8. The aerosol generating device of claim 1, wherein the user input detection sensor comprises a capacitive sensor.

9. The aerosol generating device of claim 1, wherein the pressure detection sensor comprises an absolute pressure sensor.

10. A method of controlling an aerosol generating device, the method comprising:

sensing an input of a user by using a user input detection sensor;

in response to the sensing of the input of the user, obtaining, by a controller of the aerosol generating device, an initial pressure sensing value by using a pressure detection sensor; and determining, by the controller, whether a puff of the aerosol generating device has occurred based on the initial pressure sensing value.

11. The method of claim 10, wherein the determining of whether the puff has occurred comprises:

determining a reference pressure value based on the initial pressure sensing value and determining a threshold value based on the reference pressure value; and determining whether the puff has occurred based on a sensing value of the pressure detection sensor and the threshold value.

12. The method of claim 10, wherein at least a portion of an outer surface of the aerosol generating device comprises a metallic material, and the sensing of the input of the user comprises sensing a change in capacitance according to the input of the user with respect to the metallic material, by using the user input detection sensor.

13. The method of claim 10, wherein the user input detection sensor comprises a capacitive sensor.

14. The method of claim 10, wherein the pressure detection sensor comprises an absolute pressure sensor.

15. A non-transitory computer-readable medium storing computer code that is configured to, when executed by at least one processor, cause the at least one processor to execute the method of claim 10.

* * * * *